US009347739B2

(12) United States Patent
Gomirato et al.

(10) Patent No.: US 9,347,739 B2
(45) Date of Patent: May 24, 2016

(54) AUTOMATIC ADJUSTABLE BUTTSTOCK FOR SMALL ARMS

(71) Applicant: BERETTA USA CORP., Accokeek, MD (US)

(72) Inventors: Andrea Gomirato, Alexandria, VA (US); Francesco Franzini, Bethesda, MD (US)

(73) Assignee: BERETTA USA CORP., Accokeek, MD (US)

( * ) Notice: Subject to any disclaimer, the term of this patent is extended or adjusted under 35 U.S.C. 154(b) by 0 days.

(21) Appl. No.: 14/844,045

(22) Filed: Sep. 3, 2015

(65) Prior Publication Data

US 2016/0069636 A1 Mar. 10, 2016

Related U.S. Application Data

(60) Provisional application No. 62/045,627, filed on Sep. 4, 2014.

(51) Int. Cl.
*F41C 23/14* (2006.01)

(52) U.S. Cl.
CPC ..... *F41C 23/14* (2013.01)

(58) Field of Classification Search
CPC ..... F41C 23/00; F41C 23/04; F41C 23/06; F41C 23/08; F41C 23/10; F41C 23/12; F41C 23/14
USPC ..... 42/71.01, 72, 73, 74
See application file for complete search history.

(56) References Cited

U.S. PATENT DOCUMENTS

| | | | | |
|---|---|---|---|---|
| 3,137,958 | A * | 6/1964 | Lewis | F41C 23/14 42/73 |
| 5,410,833 | A * | 5/1995 | Paterson | F41C 23/06 42/73 |
| 6,564,492 | B2 | 5/2003 | Weldle et al. | |
| 7,398,616 | B1 | 7/2008 | Weir | |
| 7,793,453 | B1 * | 9/2010 | Sewell, Jr. | F41C 23/04 42/73 |
| 8,061,072 | B1 * | 11/2011 | Crose | F41C 23/04 42/71.01 |
| 8,186,090 | B1 * | 5/2012 | Chiarolanza | F41C 23/04 42/73 |

(Continued)

OTHER PUBLICATIONS

International Search Report (ISR) and Written Opinion (WO) dated Nov. 25, 2015 for International Application No. PCT/US2015/048156.

*Primary Examiner* — Bret Hayes
(74) *Attorney, Agent, or Firm* — Ladas & Parry LLP

(57) ABSTRACT

An automatic adjustable buttstock system for a small arms weapon including a buttstock and a pair of parallel rails adapted to slidably mount the buttstock on a body of the weapon, each rail having a plurality of female locking slots along its length. A lock block is employed having a pivotable spring-loaded locking lever and a pair of locking tabs adapted to engage the female locking slots disposed along the length of each rail. A volute spring disposed between a rear wall of the lock block and a cavity in the buttstock is adapted to rearwardly bias the buttstock towards a fully extended position. The locking lever is adapted to be pivoted to disengage the pair of locking tabs from the female locking slots for displacement of the buttstock between a fully shortened configuration, in which the volute spring is fully compressed, to the fully extended position as urged rearwardly by the volute spring. The locking lever is adapted to be released causing the locking tabs to engage the female locking slots at a desired position along the parallel rails to lock the buttstock.

23 Claims, 5 Drawing Sheets

(56) References Cited

U.S. PATENT DOCUMENTS

| | | | | |
|---|---|---|---|---|
| 8,631,601 | B2 | 1/2014 | Langevin et al. | |
| 2002/0050088 | A1* | 5/2002 | Sharp | F41A 23/10 42/73 |
| 2010/0071246 | A1* | 3/2010 | Vesligai | F41C 23/04 42/75.03 |
| 2010/0122482 | A1* | 5/2010 | Simms | F41C 23/14 42/1.06 |
| 2012/0151813 | A1* | 6/2012 | Brown | F41C 7/00 42/73 |
| 2014/0068987 | A1* | 3/2014 | Burt | F41C 23/16 42/16 |
| 2014/0190056 | A1* | 7/2014 | Troy | F41C 23/14 42/71.01 |
| 2014/0259848 | A1* | 9/2014 | Chvala | F41C 23/14 42/73 |

* cited by examiner

AUTOMATIC ADJUSTABLE BUTTSTOCK FOR SMALL ARMS

RELATED APPLICATION

The present application claims the benefit under 35 U.S.C. 119(e) of U.S. Provisional Appln. No. 62/045,627 filed Sep. 4, 2014, the entire contents of which are incorporated herein by reference.

BACKGROUND OF THE INVENTION

1. Field of the Invention

The present invention relates generally to buttstocks for small arms such as the M-16 or AR-15 rifles or comparable small arms weapons.

2. Related Art

Adjustable buttstocks have been regularly provided to permit a shooter to lengthen or shorten the overall configuration of the weapon to accommodate his/her size and/or the nature of the mission in which the weapon is being deployed.

SUMMARY OF THE INVENTION

The present invention in one embodiment is directed to an improved buttstock system in which the buttstock, slidingly mounted on the gun body by a pair of parallel rails, is rearwardly biased toward a fully extended full-length position by a strong volute spring. The rails in this embodiment include a series of female locking slots along their length, each defining predetermined ever-lengthening configurations for the buttstock when engaged by locking tabs carried by a pivotable spring-biased locking lever. The locking lever may be pivoted to unlock the sliding buttstock rails to permit displacement of the buttstock from a fully shortened configuration, in which the volute spring is fully compressed, to a fully-extended position of the buttstock. The user simply unlocks the rail by pressing down on the operating lever and allowing the buttstock, biased by the volute spring, to travel rearwardly until a comfortable length for buttstock position is reached. Releasing the spring-loaded operating lever forces the locking tabs to engage the locking slots at a desired position, automatically adjusting and locking the buttstock. If desired at a subsequent time, the weapon configuration can be readjusted by depressing the lever for forced further movement of the rails forwardly against the volute forces or by permitting additional rearward movement by the biasing action of the volute spring to a new position. Releasing of the locking lever will establish the newly adjusted buttstock position.

It will be appreciated that this arrangement allows the shooter to adjust the stock to a desired position without releasing his/her hands from a shooting engagement of the weapon. The design is very compact and accommodates, if desired, the possible removal of the volute spring while maintaining a desired buttstock setting. The locking lever design is ambidextrous and accommodates left-handed or right-handed shooters.

Accordingly, the present invention in one aspect provides an automatic adjustable buttstock system for a small arms weapon. The system includes a buttstock and a pair of parallel rails adapted to slidably mount the buttstock on a body of the weapon, each rail having a plurality of female locking slots along its length. The system also includes a lock block having a locking lever and having a pair of locking tabs adapted to engage the female locking slots disposed along the length of each rail. A spring disposed between a rear wall of the lock block and a cavity in the buttstock is adapted to rearwardly bias the buttstock towards a fully extended position. The locking lever is adapted to be moved to disengage the pair of locking tabs from the female locking slots for displacement of the buttstock between a fully shortened configuration, in which the spring is fully compressed, to the fully extended position of the buttstock as urged rearwardly by the spring. The locking lever is adapted to be moved back causing the locking tabs to engage the female locking slots at a desired position along the parallel rails to lock the buttstock.

The present invention in another aspect provides an automatic adjustable buttstock system for a small arms weapon. The system includes a buttstock mounted on a pair of parallel rails each having a plurality of correspondingly spaced locking recesses formed along its length. The system also includes a lock block supporting a pivotable locking lever having a pair of parallel inverted U-shaped arms supporting a pair of locking tabs adapted to engage the locking recesses formed along the length of each rail, the locking lever being spring loaded to bias the locking lever in an upward or closed locking position. A spring is disposed between a rear wall of the lock block and a cavity in the buttstock, the spring being adapted to rearwardly bias the buttstock towards a fully extended position. The U-shaped arms of the locking lever are adapted to be pivoted downwardly by a depression force against the spring loading bias of the locking lever, to move the locking lever to a downward or open locking position, to thereby disengage the pair of locking tabs from the locking recesses to permit the rails to slide along channels within the lock block as urged rearwardly by the spring such that displacement of the buttstock occurs between a fully shortened configuration, in which the spring is fully compressed, to the fully extended position of the buttstock. The locking lever is adapted to be released from the depression force, causing the locking tabs to move back to the upwards or closed locking position to engage the female locking slots at a desired position along the rails to thereby lock the buttstock.

For a more complete understanding of the automatic buttstock adjustment system of the present invention and for a better appreciation of its attendant advantages, reference should be made to the following detailed description of the invention taken in conjunction with the accompanying drawings.

DETAILED DESCRIPTION OF THE INVENTION

Figure 1:
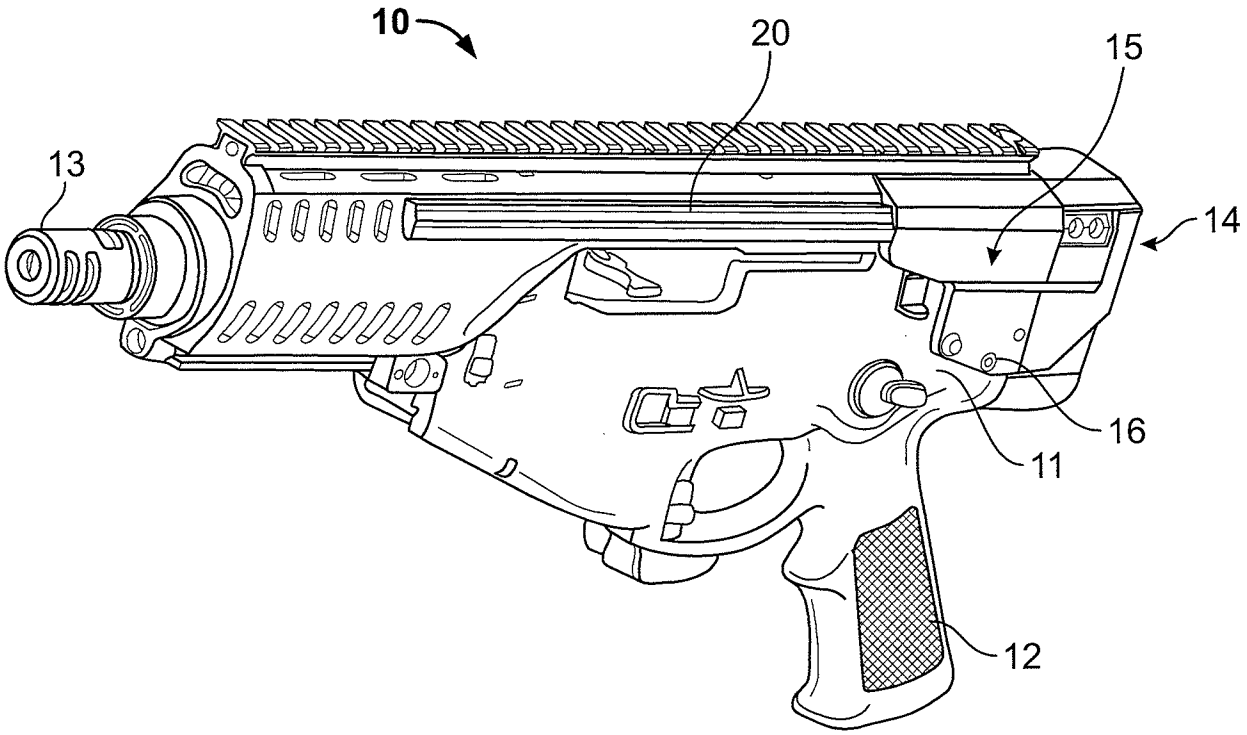
FIG. 1 is a perspective view of a small arms weapon with the buttstock assembly of the invention attached thereto with the buttstock in its forwardmost position.
Figure 2:
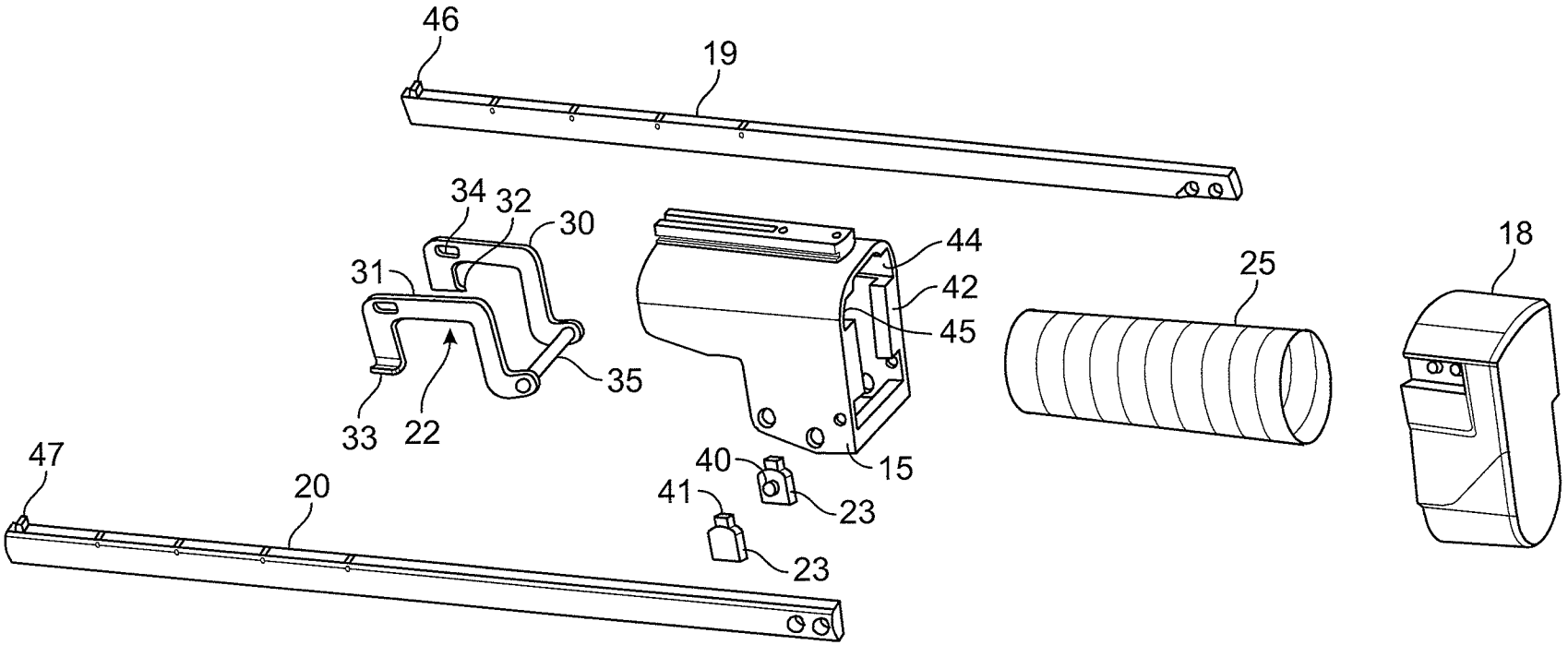
FIG. 2 is an exploded perspective view of the components of the adjustable buttstock assembly.
Figure 3:
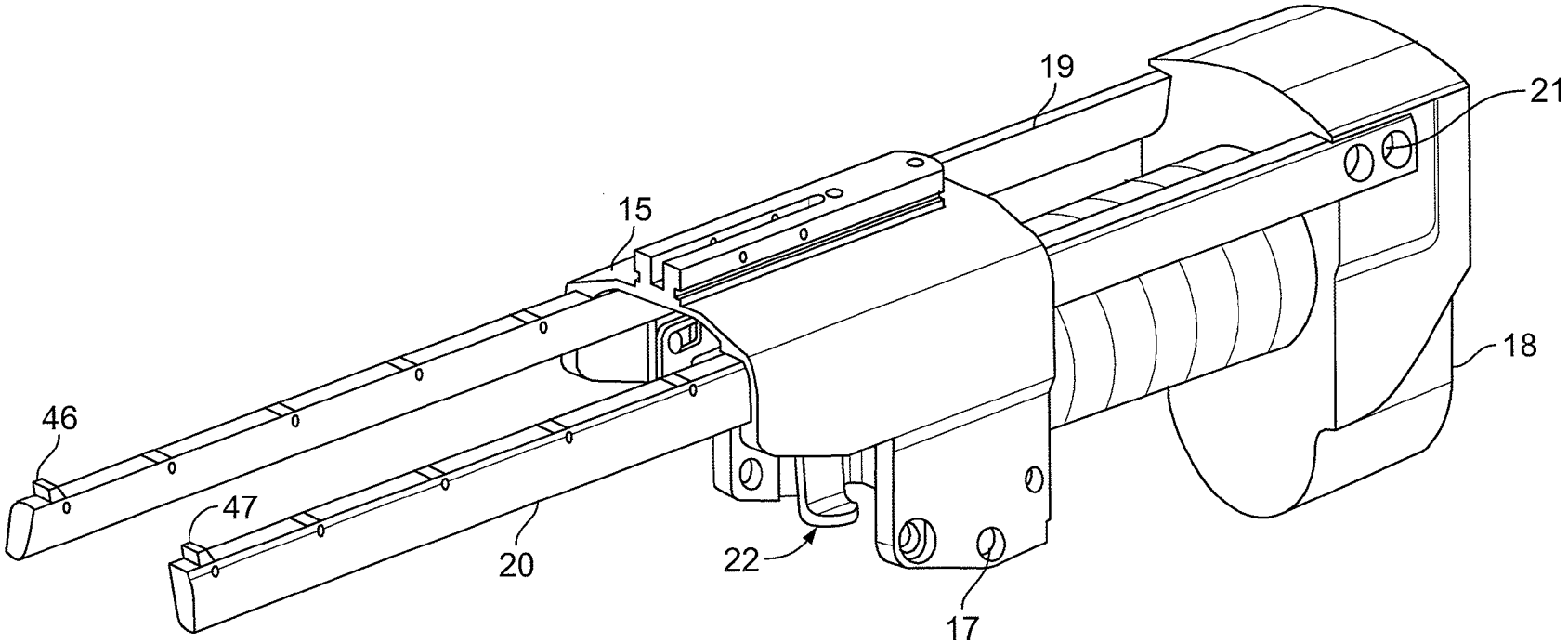
FIG. 3 is a perspective view of the buttstock assembly.
Figure 4:
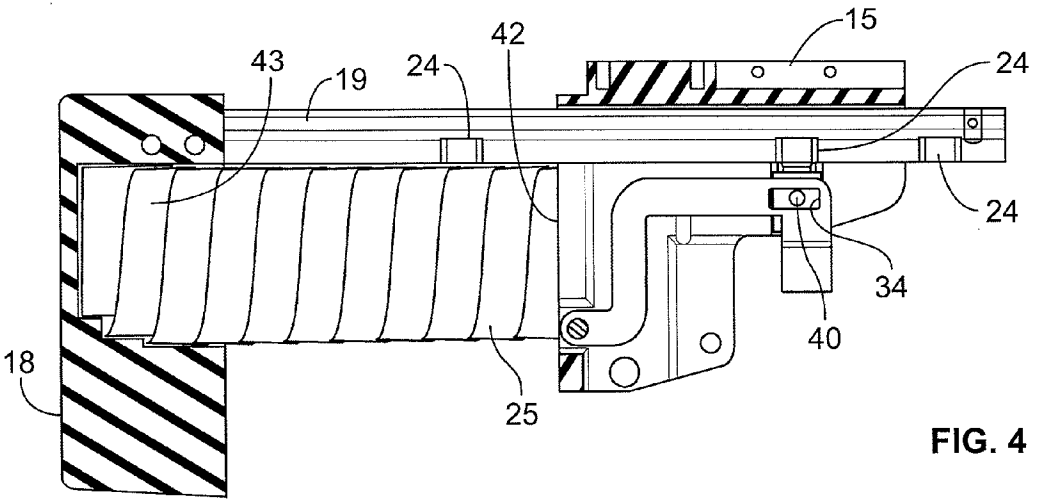
FIG. 4 is a cross-sectional view of the butttstock assembly with the adjustment locking lever in a "closed," lever-elevated position locking the buttstock in a fixed intermediate position.
Figure 5:
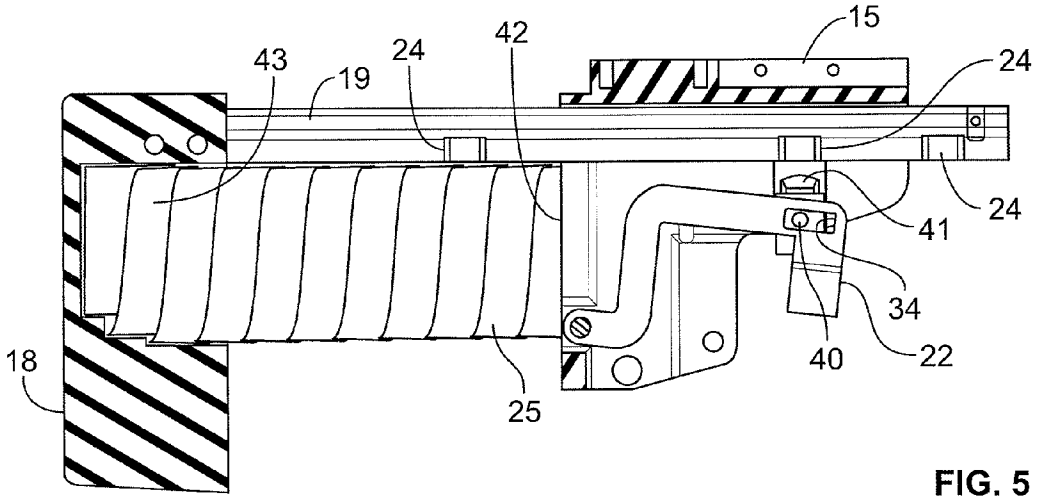
FIG. 5 is a cross-sectional view of the buttstock assembly in an "open," lever depressed position permitting the rails to slide through the locking block.

Referring to FIGS. 1-5, a small arms weapon 10 with a frame 11, handgrip 12, and barrel 13, has the new buttstock assembly 14 fastened thereto by screws 16 passing through holes 17 in a lock block 15.

The buttstock assembly 14 comprises the lock block 15; buttstock 18 mounted by screws 21 on parallel horizontal rails 19, 20 having a series of spaced locking recesses 24 formed along the length of the rails 19, 20 at the lower edges thereof; a pivotable, bi-lateral actuating lever 22 having right- and left-handed inverted substantially U-shaped arms 30, 31 (as viewed from the rearward end of the weapon) supporting locking tabs 23 in slots 34; and a volute spring 25.

Of course, while screws 16 and 21 are employed in this embodiment, in other embodiments the buttstock assembly 14 can be fastened to the frame 11 by a mechanical means different from screws 16, and the buttstock 18 can be mounted to the rails 19, 20 by a mechanical means different from screws 21, as would be understood by a person having ordinary skill in the art.

Figure 6:
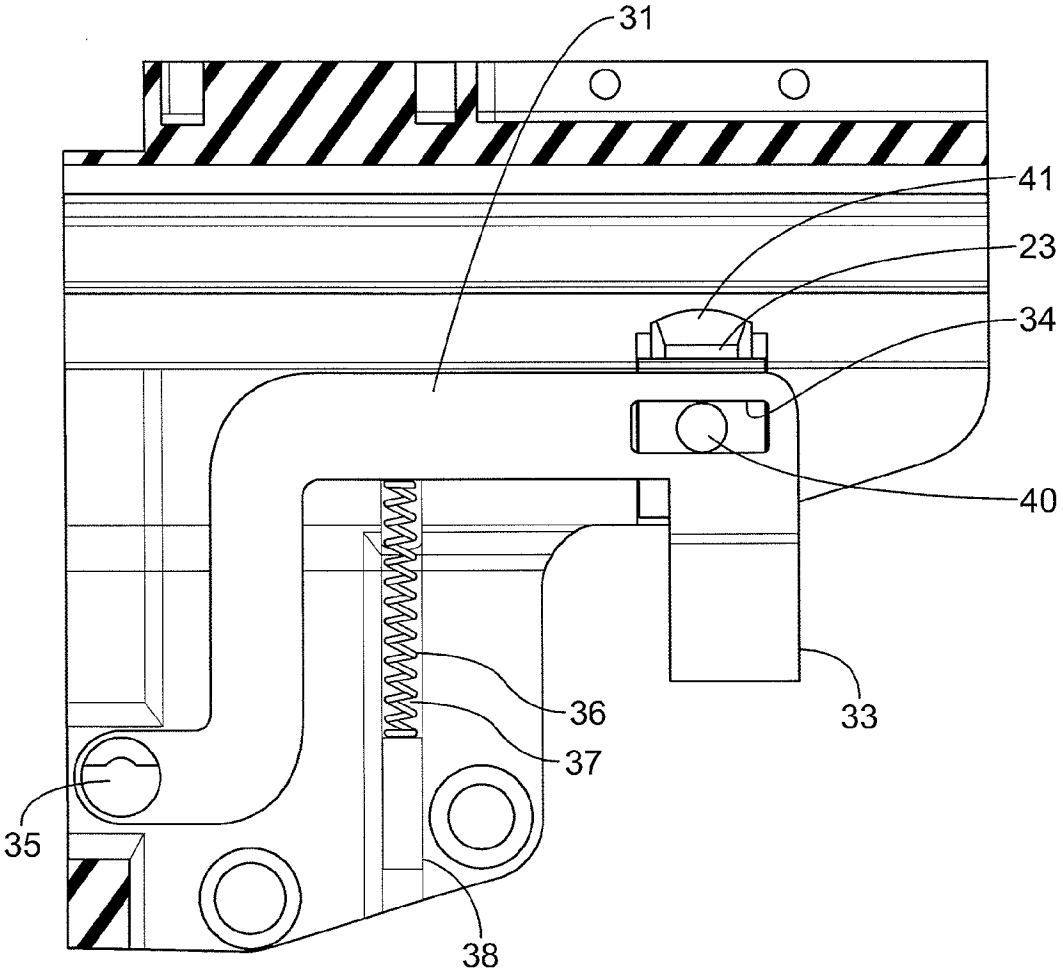
FIG. 6 is an enlarged cross-sectional view showing the coil spring biasing of the locking lever.

The arms 30, 31 of the lever 22 each terminate with outwardly projecting fingers 32, 33 respectively which may be engaged by a shooter to pivot the lever 22 downwardly. Specifically, the lever 22 is pivotably mounted on a pivot bar 35 supported in the lock block 15 so that the arms 30, 31 may be pivoted downwardly (FIG. 5) to withdraw locking tabs 23 from locking recesses 24 from which the tabs are engaged (FIG. 4 and FIG. 6) when the lever 22 is in an upward, "normally closed" locking position into which it is urged by coil springs 36 disposed in cylindrical openings 37 arranged in alignment with the arms 30, 31. The springs 36 are held in place by pins 38 press fit into the openings 37 and act on the undersides of the arms 30, 31 to urge them upwardly into locking position.

The locking tabs 23 are slidingly mounted in slots 34 in the arms 30, 31 by pins 40. Thus when the fingers 32 or 33 are depressed, the slots 34 will cam the tabs' 23 uppermost locking projections 41 downwardly out of recesses 24 to free the rails 19, 20 for horizontal movement in channels 44, 45 in the lock block 15 under the influence of the volute spring 25 acting between the spring cavity 43 in the buttstock 18 and rear wall 42 of the lock block.

In operation, the buttstock assembly 14 may be fastened to a small arms weapon as shown in FIG. 1 with the buttstock 18 in its most compact, least extended position, proximate to the pistol grips 12. In the most compact position of FIG. 1, the volute spring 25 is fully compressed and the rails 19, 20 project fully forwardly of the lock block 15 in which they are slidingly supported.

In accordance with the principles of the invention, the buttstock 18 on the rails 19, 20 may be released for automatic positioning rearwardly with respect to the pistol grip 12 under the bias of the volute spring 25, by depressing the right or left hand finger 32, 33 to pivot the lever arms 30, 31 downwardly against the bias of upwardly acting coil springs 36. (In this embodiment a coil spring 36 is used but it is of course understood that other types of springs could be used as well.) This will retract locking tabs 23 from the rearward most recesses 24 in the rails 19, 20 allowing the buttstock 18 to travel rearwardly lengthening the spacing of the buttstock 18 from the pistol grip 12 until the shooter chooses a desired comfortable length. At this point, the depression force on the finger 32 or 33 is released and the lever under the bias of coil springs 36 automatically sets the adjusted length by urging the locking tabs 23 into the associated locking recesses 24 on the rails 19, 20. The maximum lengthening of the buttstock spacing is limited by stops 46, 47 (FIG. 2, FIG. 3) formed at the forward ends of the rails 19, 20 as will be understood.

Once the buttstock 18 is adjusted for a particular user, it need not be re-positioned and, if locked in place at a fixed length, the volute spring 25 may be removed while maintaining the fixed buttstock deployment. That is, the buttstock 18 can be used also without the volute spring 25. The user would remove the volute spring 25 and then use the buttstock 18 as a standard stock without the spring 25. In this case, it would in effect become a manual actuated buttstock.

Readjustment of the buttstock 18 may be simply and quickly achieved by depressing the fingers 32 or 33, it being appreciated that in the above embodiments the pivotable, bi-lateral actuating lever 22 accommodates ambidextrous operation, to unlock the chosen setting and permit lengthening or shortening to the extent necessary.

It is noted that while a pivotable, bi-lateral actuating lever 22 is used in the above embodiments, in alternate embodiments other types of locking mechanisms can be employed to achieve the same or similar results, for example a non-pivotable actuating lever or unit which uses a different mechanism to engage and withdraw locking tabs 23 from locking recesses 24. The present invention can be "non-ambidextrous" thereby allowing the possibility to use a number of different designs for the locking mechanism, as would be understood by a person having ordinary skill in the art.

It is noted that while in the above embodiments a volute spring 25 is used, in other embodiments other types of springs could be used, including compression springs, helical springs, coil springs, tension springs, conical springs, cylindrical springs, and others. Any suitable spring or tension device can be used.

It should be understood, of course, that the specific form of the invention herein illustrated and described is intended to be representative only, as certain changes may be made therein without departing from the clear teachings of the disclosure.

In addition, it should be understood that the figures illustrated in the attachments, which highlight the functionality and advantages of the present invention, are presented for example purposes only. The architecture of the present invention is sufficiently flexible and configurable, such that it may be utilized (and navigated) in ways other than that shown in the accompanying figures.

The invention claimed is:

1. An automatic adjustable buttstock system for a small arms weapon, comprising:

a buttstock;

a pair of parallel rails adapted to slidably mount the buttstock on a body of the weapon, each rail having a plurality of female locking slots along its length;

a lock block having a locking lever and having a pair of locking tabs adapted to engage the female locking slots disposed along the length of each rail;

a spring disposed between a rear wall of the lock block and a cavity in the buttstock, the spring being adapted to rearwardly bias the buttstock towards a fully extended position, wherein the locking lever is adapted to be moved to disengage the pair of locking tabs from the female locking slots for displacement of the buttstock between a fully shortened configuration, in which the spring is fully compressed, to the fully extended position of the buttstock as urged rearwardly by the spring, and wherein the locking lever is adapted to be moved back causing the locking tabs to engage the female locking slots at a desired position along the parallel rails to lock the buttstock.

2. The system of claim 1, wherein the spring is adapted to be removable once the buttstock is locked in place at a fixed length such that the system is usable manually without the spring.

3. The system of claim 1, further comprising a pair of protruding stops each formed towards a forward end of each rail such that a maximum lengthening of the buttstock is limited by the protrudring stops.

4. The system of claim 1, wherein the locking lever is a pivotable spring-loaded locking lever and the spring loading of the locking lever is achieved by at least one additional spring that acts on undersides of the locking lever to urge the locking lever upwardly.

5. A small arms weapon comprising the automatic adjustable buttstock system of claim 1.

6. The system of claim 1, wherein the spring is a volute spring.

7. An automatic adjustable buttstock system for a small arms weapon, comprising:

a buttstock mounted on a pair of parallel rails each having a plurality of correspondingly spaced locking recesses formed along its length;

a lock block supporting a pivotable locking lever having a pair of parallel inverted U-shaped arms supporting a pair of locking tabs adapted to engage the locking recesses formed along the length of each rail, the locking lever being spring loaded to bias the locking lever in an upward or closed locking position;

a spring disposed between a rear wall of the lock block and a cavity in the buttstock, the spring being adapted to rearwardly bias the buttstock towards a fully extended position, wherein the U-shaped arms of the locking lever are adapted to be pivoted downwardly by a depression force against the spring loading bias of the locking lever, to move the locking lever to a downward or open locking position, to thereby disengage the pair of locking tabs from the locking recesses to permit the rails to slide along channels within the lock block as urged rearwardly by the spring such that displacement of the buttstock occurs between a fully shortened configuration, in which the spring is fully compressed, to the fully extended position of the buttstock, and wherein the locking lever is adapted to be released from the depression force, causing the locking tabs to move back to the upwards or closed locking position to engage the female locking slots at a desired position along the rails to thereby lock the buttstock.

8. The system of claim 7, wherein the buttstock is mounted on the parallel horizontal rails by screws.

9. The system of claim 7, wherein the pair of parallel inverted U-shaped arms support the pair of locking tabs in a pair of slots, one slot formed in each U-shaped arm.

10. The system of claim 9, wherein the pair of locking tabs are slidably mounted in the pair of slots by a pair of corresponding pins.

11. The system of claim 7, wherein the spring loading of the locking lever is achieved by a pair of coil springs disposed in corresponding cylindrical openings in alignment with the U-shaped arms, such that the coil springs act on undersides of the U-shaped arms to urge the arms upwardly into the upwards or closed locking position.

12. The system of claim 11, wherein the pair of coil springs are held in place by a pair of pins press fit into the corresponding cylindrical openings.

13. The system of claim 7, wherein the locking lever has a pivot bar which is supported in the lock block for pivotably mounting the locking lever on the lock block.

14. The system of claim 7, wherein the U-shaped arms each terminate with outwardly projecting fingers which are adapted to pivot the locking lever downwardly and against the spring loading of the locking lever when the fingers are subject to a depression force, to release the buttstock for automatic positioning rearwardly as urged by the spring.

15. The system of claim 14, wherein when the depression force on the fingers is released the locking tabs are urged into the corresponding locking recesses on the rails upon alignment at the desired position to lock the buttstock.

16. The system of claim 14, further comprising a pair of protruding stops each formed towards a forward end of each rail such that a maximum lengthening of the buttstock is limited by the protruding stops.

17. The system of claim 7, wherein the spring is adapted to be removable once the buttstock is locked in place at a fixed length such that the system is usable manually without the spring.

18. A small arms weapon comprising the automatic adjustable buttstock system of claim 7.

19. The system of claim 7, wherein the spring is a volute spring.

20. A small arms weapon, comprising:

a frame;

a handgrip secured to the frame;

a barrel secured to the frame; and an automatic adjustable buttstock system, comprising:

a buttstock mounted on a body of the weapon;

a pair of parallel rails adapted to slidably mount the buttstock on a body of the weapon, each rail having a plurality of female locking slots along its length;

a lock block secured to the frame and having a pivotable spring-loaded locking lever and having a pair of locking tabs adapted to engage the female locking slots disposed along the length of each rail;

a spring disposed between a rear wall of the lock block and a cavity in the buttstock, the spring being adapted to rearwardly bias the buttstock towards a fully extended full-length position, wherein the locking lever is adapted to be pivoted to disengage the pair of locking tabs from the female locking slots for displacement of the buttstock between a fully shortened configuration, in which the spring is fully compressed, to a fully extended position of the buttstock as urged by the spring, and wherein the locking lever is adapted to be released causing the locking tabs to engage the female locking slots at a desired position along the parallel rails to lock the buttstock.

21. The small arms weapon of claim 20, wherein the automatic adjustable buttstock system further comprises a pair of protruding stops each formed towards a forward end of each rail such that a maximum lengthening of the buttstock is limited by the protrudring stops.

22. The small arms weapon of claim 20, wherein the spring loading of the locking lever is achieved by at least one additional spring that acts on undersides of the locking lever to urge the locking lever upwardly.

23. The small arms weapon of claim 20, wherein the spring is a volute spring.

* * * * *